US011584580B2

(12) United States Patent
Harvey

(10) Patent No.: US 11,584,580 B2
(45) Date of Patent: Feb. 21, 2023

(54) SHOCK ABSORBER CONTAINER

(71) Applicant: Kerin Harvey, Glen Head, NY (US)

(72) Inventor: Kerin Harvey, Glen Head, NY (US)

( * ) Notice: Subject to any disclaimer, the term of this patent is extended or adjusted under 35 U.S.C. 154(b) by 178 days.

(21) Appl. No.: 17/113,356

(22) Filed: Dec. 7, 2020

(65) Prior Publication Data

US 2022/0063893 A1 Mar. 3, 2022

Related U.S. Application Data

(60) Provisional application No. 63/071,041, filed on Aug. 27, 2020.

(51) Int. Cl.
*B65D 81/38* (2006.01)
*B65D 81/02* (2006.01)
*A47G 21/18* (2006.01)

(52) U.S. Cl.
CPC ..... *B65D 81/022* (2013.01); *A47G 21/18* (2013.01); *B65D 2581/02* (2013.01)

(58) Field of Classification Search
CPC ..... F25D 2331/803; F25D 2331/809; F25D 3/08; B65D 81/3881; B65D 81/3876; B65D 81/022; B65D 23/0885; B65D 2581/02; A47G 21/18; A61J 1/16; A61J 1/165
USPC ..... 220/739, 903, 521
See application file for complete search history.

(56) References Cited

U.S. PATENT DOCUMENTS 8,061,551 B2 * 11/2011 Matlovich ..... B65D 81/3865 220/737
10,279,721 B1 * 5/2019 Nelson ..... B60N 3/103
2009/0266737 A1 * 10/2009 Cole ..... A47G 19/2288 220/636
2010/0108693 A1 * 5/2010 Zhang ..... B65D 1/265 220/592.2
2010/0264154 A1 * 10/2010 Pitcher ..... B65D 25/34 220/738
2020/0260892 A1 * 8/2020 Opheim ..... A47G 23/0216

* cited by examiner

*Primary Examiner* — King M Chu
(74) *Attorney, Agent, or Firm* — Brennan, Manna & Diamond, LLC

(57) ABSTRACT

A shock absorbing container for retaining a beverage container or a beverage. The shock absorbing container is configured to absorb jarring or jolting impacts to reduce the likelihood of a spill. The shock absorbing container comprises a support structure, a base shock absorbing component, and a retaining insert. The support structure is rigidly constructed. The base shock absorbing component surrounds a base portion of the support structure. The retaining insert is insertable within an upper portion of the support structure and retains the beverage container or beverage. A rim shock absorbing component is house within the retaining insert to absorb impacts to a rim of the container. A lid and straw may engage the retaining insert to retain a beverage when a separate beverage container is not used.

19 Claims, 5 Drawing Sheets

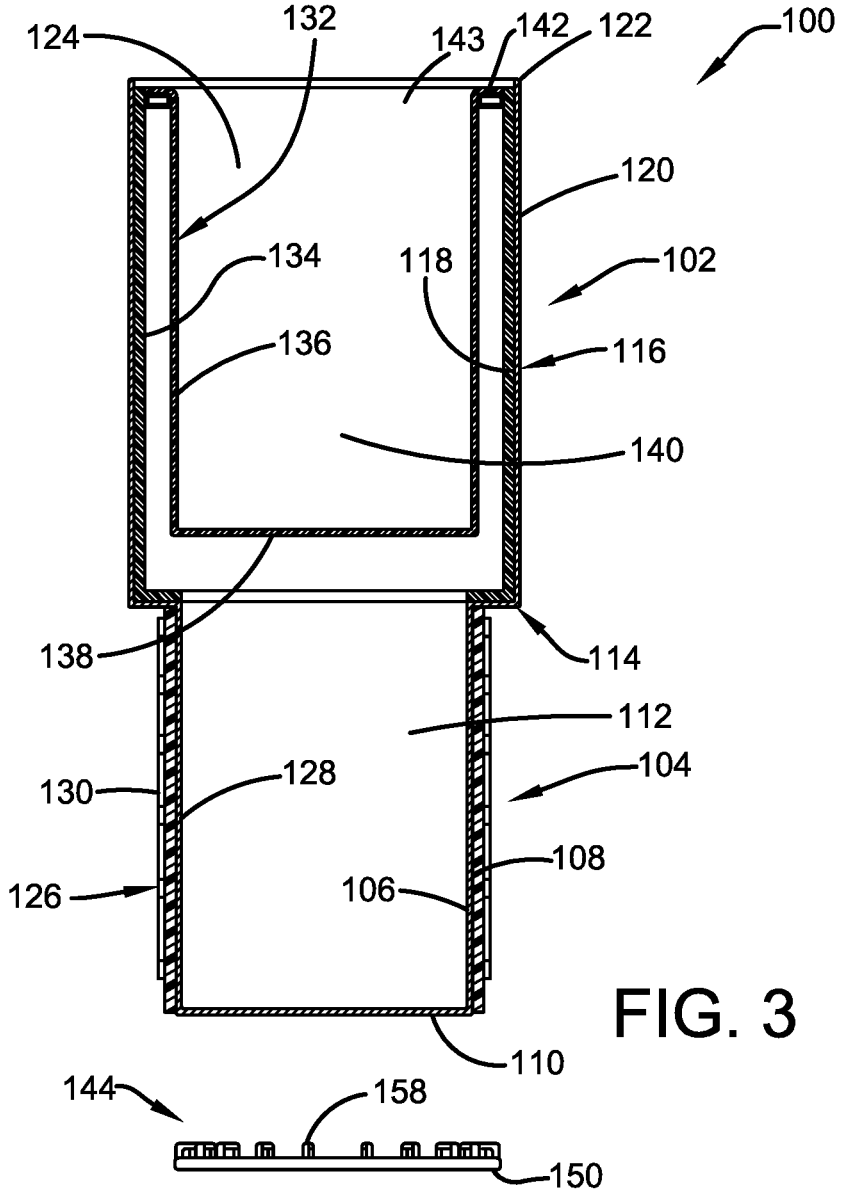
FIG. 3
FIG. 4
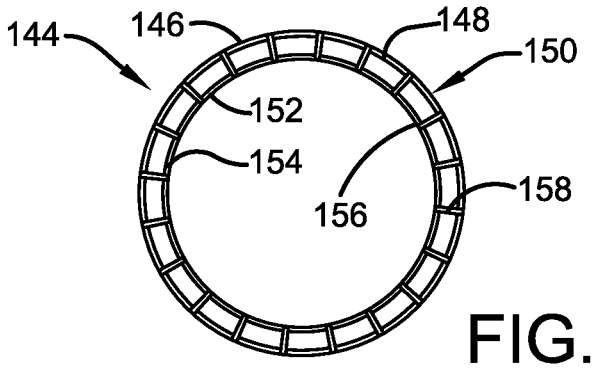
FIG. 5

SHOCK ABSORBER CONTAINER

CROSS-REFERENCE TO RELATED APPLICATION

The present application claims priority to, and the benefit of, U.S. Provisional Application No. 63/071,041, which was filed on Aug. 27, 2020 and is incorporated herein by reference in its entirety.

BACKGROUND

The present invention generally relates to a shock absorbing device, and more specifically to a container configured to protect a beverage container or a beverage from external forces that could cause a spill. Accordingly, the present specification makes specific reference thereto. However, it is to be appreciated that aspects of the present invention are also equally amenable to other like applications, devices and methods of manufacture.

The average person consumes several beverages each day. While beverages are often consumed at home, many people use a travel container of some kind. They often require temperature maintenance to consume the beverages at their convenience. Unfortunately, carrying or transporting a standard cup or travel mug can lead to spills, especially when walking or traveling over uneven terrain. Pushing a child in a stroller can be dangerous with a hot beverage endangering the child in the event of a spill. Vehicle interiors can be stained and ruined due to beverage spills in addition to burning the occupants.

The popularity of consuming beverages on the go has significantly increased over the years as we live in a highly mobile society. It is commonly recommended to consume several glasses of water or similar beverage daily. It is increasingly inconvenient to find sources of water in public when thirsty. Carrying a ready source of water in a travel container is one solution. A reusable container allows the user a ready source of water that is refillable at their convenience when they come across a water source.

There are clear benefits to using reusable travel beverage containers. Disposable containers contribute to unnecessary waste. Landfills are filled with these disposable containers, even if they are recyclable. This contributes to an unnecessary waste of resources and a negative impact on the environment, Reusable containers help alleviate this problem as they save resources and decrease the environmental impact.

One common problem with travel beverage containers is the poor response to shocks and impacts. A paper beverage cup would completely collapse if bumped or dropped. A plastic water bottle would dent or collapse as well. Ceramic or glass containers will shatter, and metal containers can dent. All of these containers will spill the contained beverage when dropped if the container is not sealed. Similarly, even jarring motions can easily cause a spill. Travel containers are often not sealed as it does not permit the user to consume the beverage at their convenience without unsealing the container.

In this manner, the improved shock absorbing container of the present invention accomplishes all of the forgoing objectives, thereby providing an easy solution to keep beverages safe. A primary feature of the present invention is that the shock absorbing container provides shock protection for existing travel beverage containers. Finally, the improved shock absorbing container of the present invention is capable of allowing the user to use the container as an independent beverage container with shock protection.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises a shock absorbing container. The shock absorbing container is configured to retain a beverage or a beverage container. The shock absorbing container comprises a support structure, a base shock absorbing component, and a retaining insert. The support structure is rigidly constructed and comprises a base portion, an upper portion, and a transition portion connecting the base and upper portions. The base portion is substantially hollow and is tubular in shape dimensioned to fit into a cup holder. The upper portion is also tubular in shape and is larger in diameter than the base portion. The upper portion comprises a rim surrounding an opening in the upper portion for receiving the retaining insert.

The base shock absorbing component comprises a first layer and a second layer. The first layer surrounds and is attached to an outer wall of the base portion. Both the first and second layers are manufactured from shock or impact resistant materials. The first layer is typically a solid layer of material. The second layer may be a solid layer of material or a lattice structure of material attached to the first layer. The base shock absorbing component is configured to at least partially absorb an externally applied force to a base portion of the support structure.

The retaining insert is a shock absorbing component insertable within the opening of the upper portion of the support structure. The beverage or the beverage container is retained within the retaining insert. The retaining insert comprises an external sidewall and an internal sidewall. The external sidewall abuts an inner wall of the upper portion of the support structure. The internal sidewall is separated from the external sidewall by a void space. The external and internal sidewalls are connected by a rim at an opening into the retaining insert. The retaining insert further comprises a base portion extending inward from the internal sidewall forming a floor to support or retain the beverage or beverage container. The retaining insert is configured to at least partially absorb an externally applied force to an upper portion of the support structure.

The shock absorbing container further comprises a rim opening shock absorbing component. The rim opening shock absorbing component is positional within the retaining insert adjacent to the rim between the external and internal sidewalls. The rim opening shock absorbing component comprises an inner ring and an outer ring. The inner ring is attached to the outer ring via a plurality of dome-shaped impact absorbing connectors. The plurality of impact absorbing connectors flexibly connect a top of the inner ring to a top of the outer ring spanning a gap between the inner and outer rings. The rim opening shock absorbing component is configured to at least partially absorb an externally applied force to cup.

The shock absorbing container may further comprise a lid and a straw. The lid engages the opening of the retaining insert to enclose the retaining insert when holding a beverage. The lid comprises a gasket fitted into a groove in a perimeter of the lid for frictionally engaging the internal sidewall of the retaining insert. The gasket forms a liquid-tight seal between the lid and the internal sidewall of the retaining insert. The lid further comprises an opening for accessing the retained beverage and for insertion of the straw. The straw comprises a one-way liquid flow valve positioned within an interior passage of the straw.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which:

FIG. 3 illustrates a cutaway side view of the shock absorbing container of the present invention in accordance with the disclosed architecture.

FIG. 4 illustrates a side view of a rim shock absorbing component of the shock absorbing container of the present invention in accordance with the disclosed architecture.

FIG. 5 illustrates an overhead view of the rim shock absorbing component of the shock absorbing container of the present invention in accordance with the disclosed architecture.

DETAILED DESCRIPTION

Figure 1:
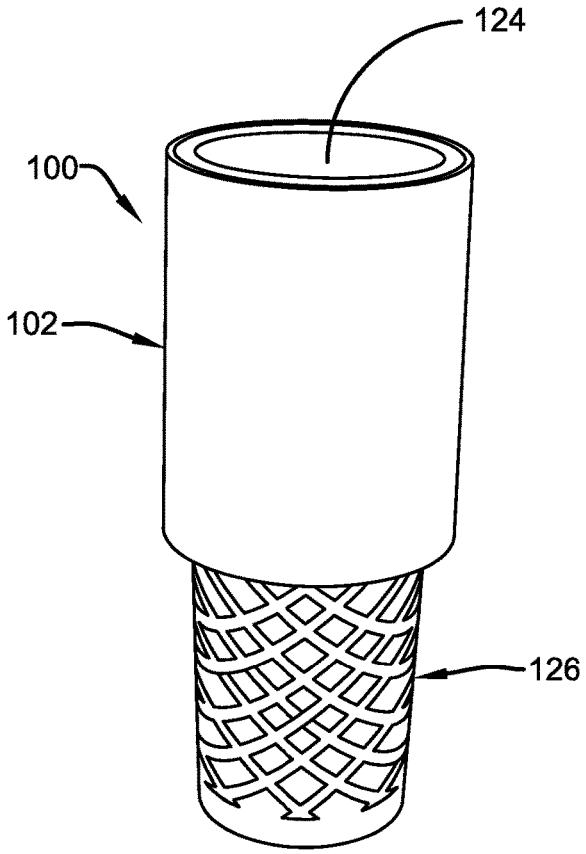
FIG. 1 illustrates a perspective view of one embodiment of a shock absorbing container of the present invention for retaining a beverage container or a beverage in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They do not intend as an exhaustive description of the invention or do not limit the scope of the invention. Additionally, an illustrated embodiment need not have all the aspects or advantages shown. Thus, in other embodiments, any of the features described herein from different embodiments may be combined.

The present invention provides users with a beverage container attachment or cup holder capable of supporting a travel mug, bottles, cups, and the like. The beverage container attachment features an internal membrane capable of absorbing shock and eliminating any jarring or jolting motion that could result in a spill. The invention also includes an internal straw with a valve for conveniently consuming any hot, warm, or cold liquid beverage stored within. The beverage container attachment enables users to place the device in a cup holder, a stroller cup holder, a chair cup holder, and more ensuring that the beverage is contained in a stable format and is ready to be consumed. The invention functions as an independent beverage container when a lid is applied allowing the user to consume their favorite beverages without having to carry around both a travel mug and the device.

The shock absorbing device may be a metallic or plastic cup holder designed to absorb any shock to a cup or mug for preventing spills. In one embodiment, the device comprises a domed mechanism with silicon and rubber membranes dimensioned to receive a travel mug within and to absorb jarring and jolting motions. The internal membrane functions as a shock absorber, decreasing the likelihood of a spill. A lid with an integrated straw valve component may be attached to the device so that the device functions as an independent beverage container.

Users may insert a travel coffee mug, hot beverage container, cup, bottle, or other beverage container within the device. Once the mug is secured within the device, the internal membranes help prevent spills. The user may then hold onto the device or place it in a cup holder for transport. Alternatively, the device can be directly filled with a liquid, receive the modified lid, and utilize the straw to consume the beverage.

Figure 6:
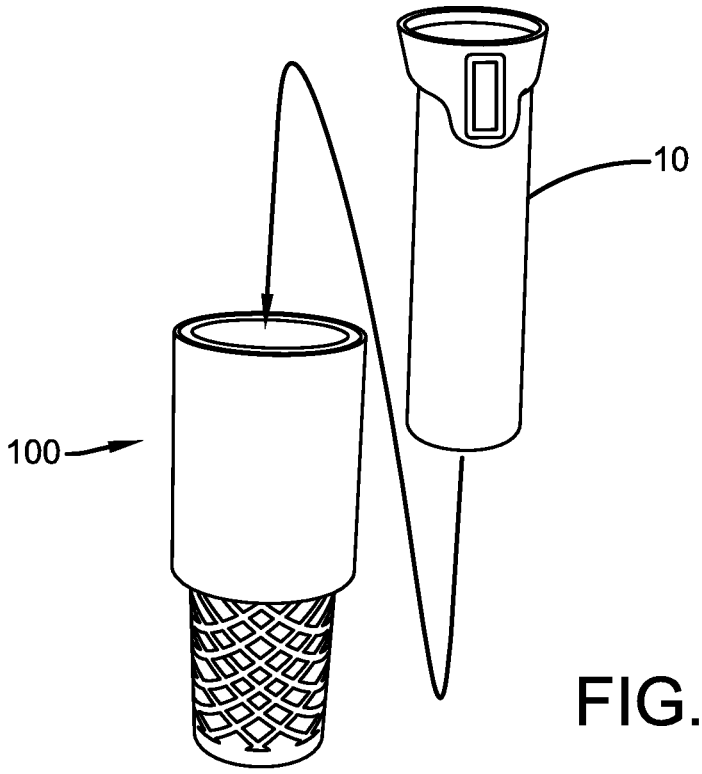
FIG. 6 illustrates a perspective view of a beverage container for use with the shock absorbing container of the present invention in accordance with the disclosed architecture.
Figure 6A:
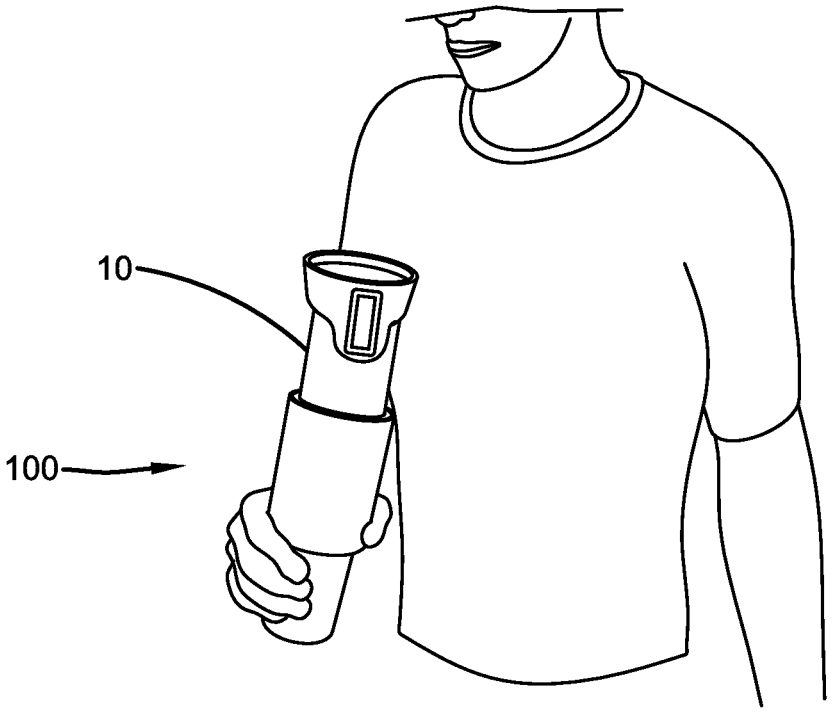
FIG. 6A illustrates a perspective view of the beverage container being inserted in the shock absorbing container of the present invention in accordance with the disclosed architecture.

Referring initially to the drawings, FIGS. 1-13 illustrates a shock absorbing container 100. The shock absorbing container 100 is configured to retain a beverage or a beverage container 10 as illustrated in FIGS. 6 and 6A. The shock absorbing container 100 comprises a support structure 102, a base shock absorbing component 126, and a retaining insert 132. The retaining insert 132 can hold either the beverage alone, or the beverage container 10 holding the beverage. The beverage container 10 may be any travel container, mug, bottle, can, cup, glass, or vessel that can hold a liquid.

Figure 2:
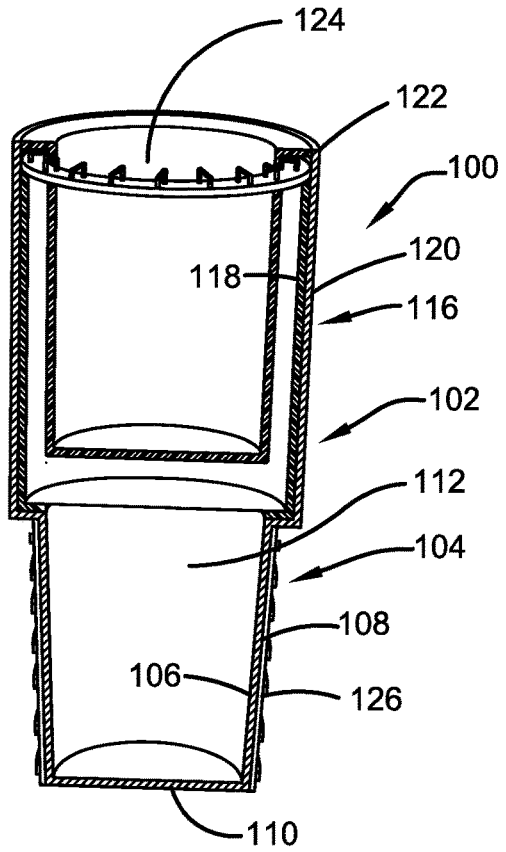
FIG. 2 illustrates a cutaway perspective view of the shock absorbing container of the present invention in accordance with the disclosed architecture.

As illustrated in FIGS. 1-3, the support structure 102 is rigidly constructed. The support structure 102 may be manufactured or molded from a lightweight metal or plastic, and may or may not be insulated. The support structure 102 comprises a base portion 104, an upper portion 116, and a transition portion 114. The transition portion 114 connects the base portion 104 and the upper portion 116. The base portion 104 is substantially hollow and is tubular in shape dimensioned to fit into a cup holder. The base portion 104 comprises an inner wall 108, an outer wall 108 and a bottom 110. The inner wall 106 defined a hollow interior 112. The base portion 104 is open opposite the bottom 110 where the transition portion 114 attaches the base portion 104 to the upper portion 116.

The upper portion 116 is also tubular in shape and is larger in diameter than the base portion 104. The lower and upper portions 104 and 116 may be circular or slightly conical in configuration. The upper portion 116 comprises an inner wall 118, an outer wall 120, and a rim 122. The rim 122 surrounds an opening 124 in the upper portion 116 opposite where the transition portion 114 attaches the base portion 104 to the upper portion 116. The transition portion 114 perpendicularly connects the base portion 104 to the upper portion 116 around a perimeter of the support structure 102.

The base shock absorbing component 126 is configured to at least partially absorb an externally applied force to the base portion 104 of the support structure 102. The base shock absorbing component 126 comprises at least a first layer 128. The base shock absorbing component 126 may further comprise a second layer 138. The first layer 128 surrounds and is attached, adhered, or otherwise connected to the outer wall 108 of the base portion 104. Both the first and second layers 128 and 130 are manufactured from shock or impact resistant materials, such as rubber compounds, flexible plastics, silicon, foams, closed cell foams, gels, cork, or any similar material with visco-elastic properties that can absorb an impact force. The first layer 128 is typically a solid layer of material. The second layer 130 may be a solid layer of material or a lattice structure of compressible or elastic material attached to the first layer 128.

Figure 7:
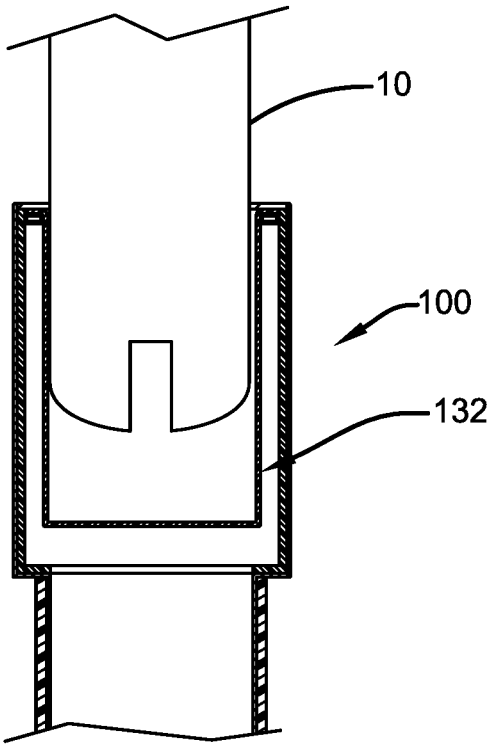
FIG. 7 illustrates a side view of the beverage container being retained within a retaining insert of the shock absorbing container of the present invention in accordance with the disclosed architecture.

The retaining insert 132 is a shock absorbing component insertable within the opening 124 of the upper portion 116 of the support structure inside the rim 122. The beverage or the beverage container 10 is retained within the retaining insert 132 as illustrated in FIG. 7. The retaining insert 132 comprises an external sidewall 134 and an internal sidewall 136. The external sidewall 136 abuts an inner wall 118 of the upper portion 116 of the support structure 102. The external and internal sidewalls 134 and 136 may be a rubber, plastic, or silicon sheet, membrane, or similar flexible structure. The internal sidewall 136 is separated from the external sidewall 134 by a cavity 140 or void space which defines the space between the external and internal sidewalls 134 and 136. Alternatively, the cavity 140 may be filled with an additional shock absorbing solid or liquid material.

The external sidewall 134 is joined to the internal sidewall 136 by a rim 142 at an opening 143 into the retaining insert 132. The retaining insert 132 further comprises a base portion 138 extending inward from the internal sidewall 136 forming a floor to support or retain the beverage or beverage container 10. The retaining insert 132 is configured to at least partially absorb an externally applied force to an upper portion 116 of the support structure 102.

As illustrated in FIGS. 2-5, the shock absorbing container 100 further comprises a rim opening shock absorbing component 144. The rim opening shock absorbing component 144 is positioned and housed within the retaining insert 132 adjacent to the rim 142 between the external and internal sidewalls 134 and 136. The rim opening shock absorbing component 144 comprises an inner ring 152 and an outer ring 146. The inner ring 152 is an annular ring of plastic or other shock absorbing material of a smaller diameter than the outer ring 146. The inner ring 152 comprises a top 154 and a bottom 156. The outer ring 146 is also an annular ring of plastic or other shock absorbing material of a larger diameter than the inner ring 152. The outer ring 146 comprises a top 148 and a bottom 150.

The inner ring 152 is attached to the outer ring 146 via a plurality of impact absorbing connectors 158. Each of the plurality of impact absorbing connectors 158 flexibly connect the top 154 of the inner ring 152 to the top 148 of the outer ring 146 spanning a gap between the inner and outer rings 152 and 146. Alternatively, the plurality of impact absorbing connectors 158 can connect the inner and outer rings 152 and 146 at any position. The rim opening shock absorbing component 144 is configured to at least partially absorb an externally applied force to the rim 122 of the upper portion 116 of the support structure 102.

Figure 8:
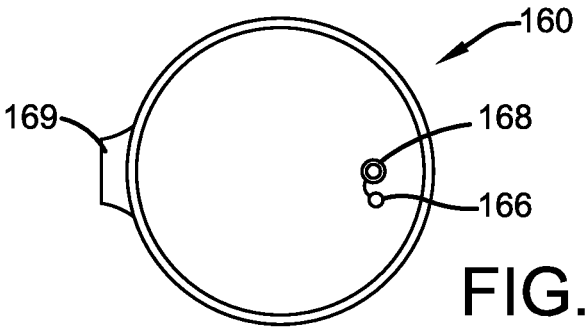
FIG. 8 illustrates an overhead view of a lid of the shock absorbing container of the present invention in accordance with the disclosed architecture.
Figure 9:
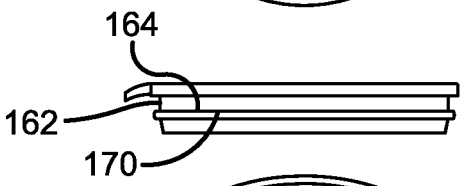
FIG. 9 illustrates a side view of the lid of the shock absorbing container of the present invention in accordance with the disclosed architecture.
Figure 10:
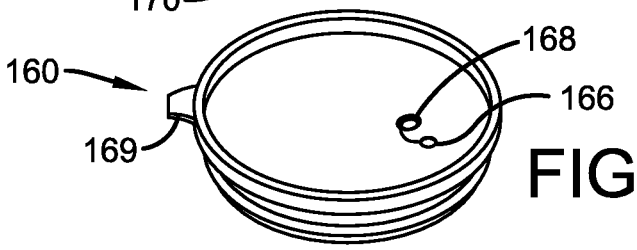
FIG. 10 illustrates a perspective view of the lid of the shock absorbing container of the present invention in accordance with the disclosed architecture.

As illustrated in FIGS. 8-10, the shock absorbing container 100 may further comprise a lid 160. The lid 160 engages the opening 143 of the retaining insert 132 to enclose the retaining insert 132 when holding a beverage without the beverage container 10. Alternatively, the lid 160 may be screw-on. The lid 160 typically comprises a perimeter 162 with a groove 164 circumferentially disposed within. A gasket 170 fits into the groove 164 and surrounds the perimeter 162 of the lid 160. The perimeter 162 of the lid 160 frictionally engages the internal sidewall 136 of the retaining insert 132. The gasket 170 forms a liquid-tight seal between the perimeter 162 and the internal sidewall 136. The lid 160 further comprises an opening 166 for accessing the retained beverage and for insertion of a straw 172. The opening 166 may be a closable opening. The opening 166 may comprise a cap 168 for covering the opening 166 when not in use. The lid 160 may further comprise a lip 169 extending out of the lid 160 for allowing the user to easily remove the lid 160.

Figure 11:
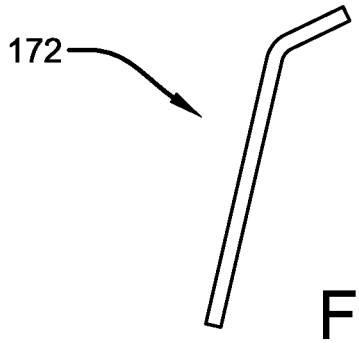
FIG. 11 illustrates a perspective view of a straw of the shock absorbing container of the present invention in accordance with the disclosed architecture.
Figure 12:
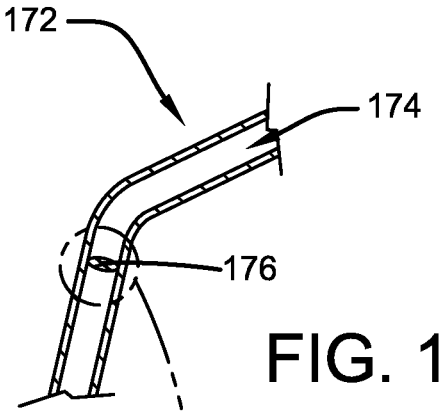
FIG. 12 illustrates a closeup cutaway view of the straw of the shock absorbing container of the present invention in accordance with the disclosed architecture.
Figure 13:
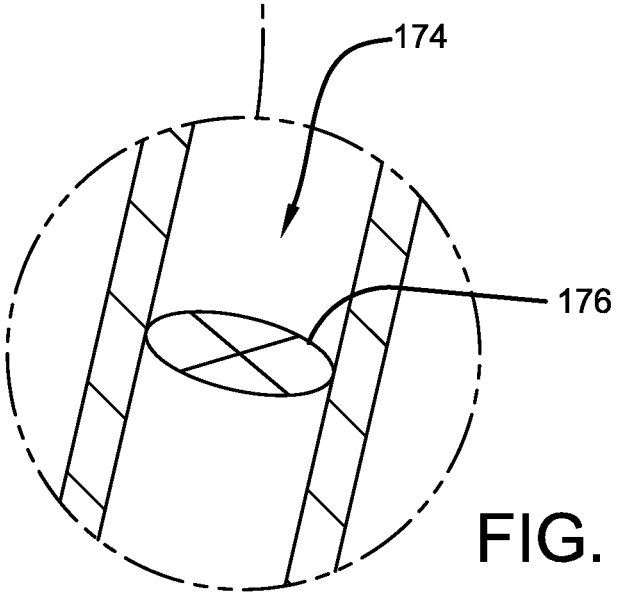
FIG. 13 illustrates a closeup cutaway of a one-way liquid flow valve of the straw of the shock absorbing container of the present invention in accordance with the disclosed architecture.

As illustrated in FIGS. 11-13, the shock absorbing container 100 may further comprise a straw 172 for inserting into the opening 166 of the lid 160. The straw 172 may be flexible or rigid in construction. The straw 172 comprises an interior passage 174 for allowing liquid to flow within. The straw 172 further comprises a one-way liquid flow valve 176. The one-way liquid flow valve 176 is positioned within the interior passage 174 of the straw 170 along its length. The one-way liquid flow valve 176 may be a check valve, or any other similar valve that permits the one-way flow of liquid once suction is applied to the straw 172.

It is contemplated that the shock absorbing container constructed in accordance with the present invention will be tailored and adjusted by those of ordinary skill in the art to accommodate various levels of performance demand imparted during actual use. Accordingly, while this invention has been described by reference to certain specific embodiments and examples, it will be understood that this invention is capable of further modifications. This application is, therefore, intended to cover any variations, uses or adaptations of the invention following the general principles thereof, and including such departures from the present disclosure as come within known or customary practice in the art to which this invention pertains and fall within the limits of the appended claims.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A shock absorbing container for retaining a beverage comprising:

a support structure;

a base shock absorbing component attached to a base portion of the support structure;

a retaining insert inserted into an upper portion of the support structure; and a rim shock absorbing component housed within the retaining insert adjacent to a rim of the retaining insert; and wherein the retaining insert comprises an external sidewall and an internal sidewall with a cavity in between.

2. The shock absorbing container of claim 1, wherein the base shock absorbing component is attached to an outer wall of the base portion.

3. The shock absorbing container of claim 1, wherein the base shock absorbing component comprises an inner layer and an outer layer.

4. The shock absorbing container of claim 1, wherein the retaining insert comprises an external sidewall and an internal sidewall.

5. The shock absorbing container of claim 4, wherein a space between the external sidewall and an internal sidewall is defined by a cavity.

6. The shock absorbing container of claim 1, wherein the retaining insert is a rubber membrane.

7. The shock absorbing container of claim 1, wherein the retaining insert is configured to retain a beverage container within.

8. A shock absorbing container for retaining a beverage container or a beverage, the shock absorbing container comprising:

a support structure;

a base shock absorbing component attached to a base portion of the support structure;

a retaining insert inserted into an upper portion of the support structure for retaining the beverage container or the beverage; and a rim shock absorbing component housed within the retaining insert adjacent to a rim of the retaining insert; and wherein the base shock absorbing component is attached to an outer wall of the base portion and comprises an inner layer and an outer layer.

9. The shock absorbing container of claim 8, wherein the retaining insert comprises an external sidewall and an internal sidewall with a cavity in between.

10. The shock absorbing container of claim 8, wherein the retaining insert is configured to at least partially absorb an externally applied force to the shock absorbing container.

11. The shock absorbing container of claim 8, wherein the rim shock absorbing component comprises an outer ring and an inner ring.

12. The shock absorbing container of claim 11, wherein the outer ring is connected to the inner ring via a plurality of impact absorbing connectors.

13. The shock absorbing container of claim 8, wherein the rim shock absorbing component is configured to at least partially absorb an externally applied force to the rim.

14. A shock absorbing container for retaining a beverage container or a beverage, the shock absorbing container comprising:

a support structure;

a base shock absorbing component attached to a base portion of the support structure;

a retaining insert inserted into an upper portion of the support structure;

a rim shock absorbing component housed within the retaining insert;

a lid for enclosing the retaining insert; and a straw insertable through the lid.

15. The shock absorbing container of claim 14, wherein the lid engages an opening of the retaining insert.

16. The shock absorbing container of claim 14, wherein the lid comprises a gasket surrounding a perimeter of the lid for forming a liquid-tight seal between the lid and the retaining insert.

17. The shock absorbing container of claim 14, wherein the lid comprises a closable opening for accessing the beverage.

18. The shock absorbing container of claim 14, wherein the straw comprises a one-way liquid flow valve positioned within an interior passage of the straw.

19. The shock absorbing container of claim 18, wherein the one-way liquid flow valve is a check valve.

* * * * *